US010428453B2

(12) United States Patent
Mayeur et al.

(10) Patent No.: US 10,428,453 B2
(45) Date of Patent: Oct. 1, 2019

(54) CHEST IRONER

(71) Applicant: Electrolux Laundry Systems France SNC, Rosieres (FR)

(72) Inventors: Oscar Mayeur, Saint-Julien-les-Villas (FR); Andre Maziere, Saint-Parres-lès-Vaudes (FR)

(73) Assignee: Electrolux Laundry Systems France SNC (FR)

( * ) Notice: Subject to any disclaimer, the term of this patent is extended or adjusted under 35 U.S.C. 154(b) by 129 days.

(21) Appl. No.: 15/573,588

(22) PCT Filed: May 13, 2015

(86) PCT No.: PCT/EP2015/060595
§ 371 (c)(1),
(2) Date: Nov. 13, 2017

(87) PCT Pub. No.: WO2016/180489
PCT Pub. Date: Nov. 17, 2016

(65) Prior Publication Data

US 2018/0202099 A1 Jul. 19, 2018

(51) Int. Cl.

| | |
|---|---|
| ***D06F 67/08*** | (2006.01) |
| *D06F 67/02* | (2006.01) |
| *D06F 65/06* | (2006.01) |

(52) U.S. Cl.
CPC ..... *D06F 67/08* (2013.01); *D06F 65/06* (2013.01); *D06F 67/02* (2013.01)

(58) Field of Classification Search
CPC ..... D06F 67/00–10; D06F 65/00–10
See application file for complete search history.

(56) References Cited

U.S. PATENT DOCUMENTS 1,834,365 A * 12/1931 Adams ..... D06F 67/02 38/60
2,415,275 A * 2/1947 Bruckman ..... D06F 67/08 219/243
4,425,489 A * 1/1984 Pav ..... F26B 13/183 100/330

(Continued)

FOREIGN PATENT DOCUMENTS

CN 103911838 7/2014
CN 203768699 8/2014

(Continued)

OTHER PUBLICATIONS

International Search Report dated Jan. 18, 2016 in corresponding International Application No. PCT/EP2015/060595.

*Primary Examiner* — Ismael Izaguirre
(74) *Attorney, Agent, or Firm* — RatnerPrestia

(57) ABSTRACT

A chest ironer having a chest, a cylinder, displacement means for displacement of the chest and the cylinder relatively each other, and rotation means for rotation of the cylinder around an axis of rotation. The chest has a curved metal plate with a concave side which faces the cylinder and a convex side opposite the concave side. The chest ironer further includes at least one induction arrangement for heating of the metal chest. The induction arrangement includes at least one electrical conductor arranged electrically isolated from the chest at the convex side of the chest, the at least one electrical conductor being connectable to a high frequency power source.

12 Claims, 5 Drawing Sheets

(56) References Cited

U.S. PATENT DOCUMENTS 4,675,487 A * 6/1987 Verkasalo ..... D21F 5/024
100/327
4,788,779 A * 12/1988 Sparkes ..... D21F 3/0281
162/206

FOREIGN PATENT DOCUMENTS

| | | | | |
|---|---|---|---|---|
| EP | 0196264 | A2 | * | 10/1986 |
| EP | 2400052 | | | 12/2011 |
| JP | 60014900 | A | * | 1/1985 |
| WO | WO 2004035907 | A1 | * | 4/2004 |

* cited by examiner

CHEST IRONER

This application is a U.S. National Phase application of PCT International Application No. PCT/EP2015/060595, filed May 13, 2015, which is incorporated by reference herein.

TECHNICAL FIELD

Embodiments herein relate to a chest ironer.

BACKGROUND

Chest ironers, sometimes also referred to as bed ironers, are commonly used for drying and ironing of sheets, towels and other items with relatively large surfaces. The chest ironers are foremost used in various professional applications, such as in hotels, laundries etc.

The chest ironer may comprise a chest, e.g. of metal, with a concave side facing a cylinder. The chest is heated during the ironing process. A periphery of the cylinder is pressed against the concave side of the chest. When the cylinder is brought to rotate, an item to be ironed may be fed in between the cylinder and the concave side of the chest by the rotating movement of the cylinder.

When the item to be ironed follows the rotating movement of the cylinder, one side of the item is facing the chest and the other side of the item is facing the cylinder. The chest and the cylinder may be pushed together such that the item is pressed and retained between the chest and the cylinder until the entire item has passed through a passage between the chest and the cylinder.

During passage between the chest and the cylinder, the item is both dried and ironed due to the friction against the concave surface of the chest and a temperature of the chest. The temperature of the chest is normally 100-200 degrees Celsius before the chest is used for ironing and/or drying of items.

The chest may be heated e.g. by electrical resistance or by circulation of hot steam or fluid within channels of the chest. The chest may alternatively be heated by means of a gas burner acting on a convex side of the chest.

Known chest ironers may be suitable in some applications, but the heat from the chest ironer may in some situations be inefficient.

SUMMARY

An object is to provide a chest ironer which is more efficient.

According to an embodiment, the object is achieved by a chest ironer comprising a chest, a cylinder, displacement means for displacement of the chest and the cylinder relatively each other and rotation means for rotation of the cylinder around an axis of rotation, the chest comprising a curved metal plate with a concave side which faces the cylinder and a convex side, the cylinder comprising a cylindrical body, wherein the chest ironer further comprises at least one induction arrangement for heating of the metal chest, the induction arrangement comprising at least one electrical conductor arranged electrically isolated from the chest at the convex side of the chest, the at least one electrical conductor being connectable to a high frequency power source.

Since the chest ironer comprises at least one induction arrangement which in turn comprises at least one electrical conductor arranged electrically isolated from the chest at the convex side of the chest for heating of the metal chest, the chest can be heated very efficiently. The induction arrangement allows the chest ironer to be heated much faster than with other techniques such as electrical resistance or circulated fluid. Hereby energy is saved and long warm-up periods are avoided.

With the induction arrangement as heating source for the chest a user can control the chest ironer in a much more precise, fast and accurate manner. The chest ironer is both heated and cooled very quickly. A user which stands near the chest ironer is therefore subject to less heat radiation from the chest, in particular during time periods when sheets or similar are not ironed for the moment.

Thus, energy is saved and the working environment for a user is improved.

According to some embodiments the induction arrangement comprises a plurality of electrical conductors which are electrically isolated from each other and the chest at the convex side of the chest.

A plurality of electrical conductors, which are electrically isolated from each other and the chest at the convex side of the chest, has proven to be very efficient for heating of the chest. With a plurality of electrical conductors the effect is increased, mainly since the "induction effect" is most prominent along an outer surface of each electrical conductor. This phenomenon is also referred to as "skin effect". Due to the high frequencies used, a current density is higher on the outer surface of the electrical conductor. Accordingly it may be efficient to use a plurality of relatively thin conductors instead of one massive conductor.

According to some embodiments, the one or more electrical conductors forms a rectangular spiral coil which extends in a plane substantially in parallel with the convex surface of the chest. In embodiments herein a rectangular spiral coil has proven to be efficient for generating and/or distributing heat over a large portion of the convex surface of the chest.

According to some embodiments, the one or more electrical conductors forms a plurality of rectangular spiral coils, each rectangular spiral coil extending in a common plane substantially in parallel with the convex side of the chest. Hereby only some of the plurality of rectangular spiral coils can be activated if desired. This may be desirable if e.g. towels with a smaller width than a width of the chest ironer are to be dried and/or ironed. In such a situation only a selected number of rectangular spiral coils needs to be activated in order to treat, such as iron, the towels.

According to some embodiments, the chest ironer comprises a temperature sensor for control of a chest temperature, i.e. a temperature of the chest, caused by the induction arrangement. The temperature sensor may be connected to any type of control system for the induction arrangement. An actual temperature may be compared with a target temperature. In this manner, the temperature of the chest may be very precisely adjusted and/or controlled.

According to some embodiments the temperature sensor is arranged at the convex side of the chest. Since the temperature sensor is arranged near the induction arrangement on the convex side of the chest the temperature may be detected very fast and accurately.

According to some embodiments the chest ironer comprises a plurality of temperature sensors for control of chest temperatures at a plurality of different positions. Hereby the temperature for the plurality of different positions can be detected and possibly adjusted in dependence of a detected temperature.

According to some embodiments the displacement means are arranged to press the chest and the cylinder towards each other. The displacement can be arranged to press, or push, the chest towards the cylinder, to press the cylinder towards the chest or both. Hereby items to be ironed can be retained between the chest and the cylinder during passage, e.g. along their path, through the chest ironer.

According to some embodiments the chest and the cylinder, when the cylinder is brought to rotate by the rotation means, are arranged to feed, press and dry a sheet material inserted between the cylinder and the concave side of the chest. Hereby a user may easily put a sheet or similar onto an upper part of the cylinder and the sheet is fed, pressed and dried by the chest ironer.

According to some embodiments the cylinder comprises a steam-permeable padding which is arranged around a periphery of the cylindrical body. The steam-permeable padding allows moisture from items to escape into apertures arranged along the periphery of the cylindrical body. In addition, the steam-permeable padding distributes the pressure caused by the displacement means such that the items to be dried are uniformly pressed against the concave side of the chest.

According to some embodiments a thickness of the curved metal plate of the chest is less than 4 mm, preferably less than 3 mm, more preferably less than 2 mm. Hereby the chest comprises less thermal inertia as compared to thicker plates. Thus, when no items to be ironed are present in the chest ironer, the temperature may be decreased quickly. When the chest ironer is started again, e.g. made ready for ironing, this may also be performed quickly due to the relatively thin metal plate.

According to some embodiments the chest ironer comprises a high frequency power source which is arranged to generate a high frequency magnetic field. In this manner, the chest ironer may be connected to a grid without need of any external high frequency power source.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings, in which embodiments are shown. Well-known functions or constructions will not necessarily be described in detail for brevity and/or clarity.

Figure 1:
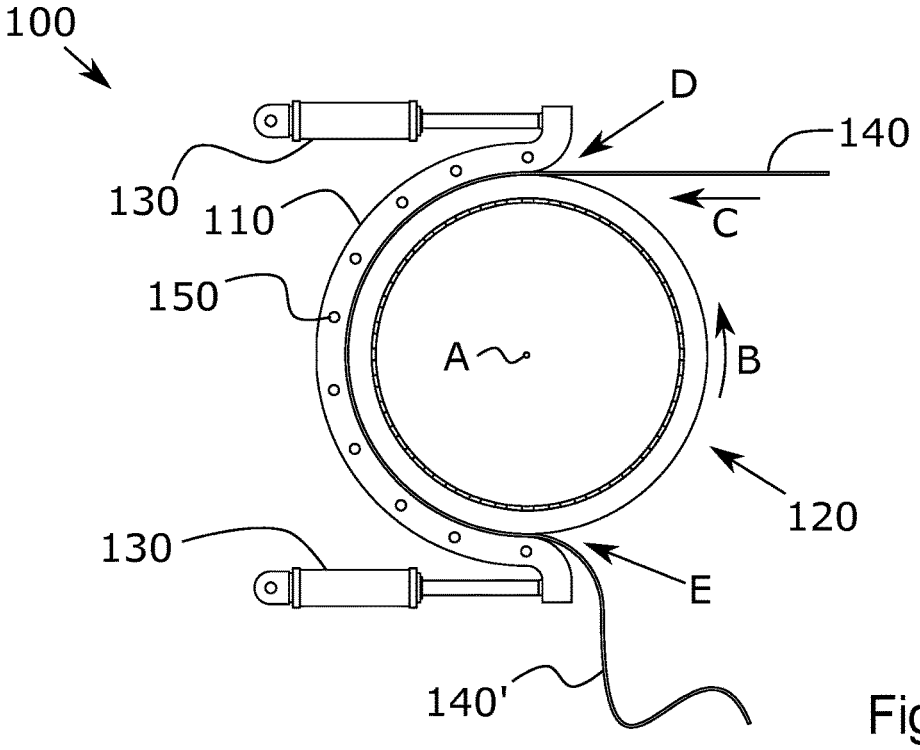
FIG. 1 illustrates a chest ironer according to the prior art.

FIG. 1 illustrates a chest ironer 100 according to the state of the art. The chest ironer 100 comprises a chest 110, a cylinder 120 and displacement means 130 for displacement of the chest 110 and the cylinder 120 relatively each other.

The chest ironer 100 further comprises means for rotating the cylinder 120 around a centre axis A. When the cylinder 120 is rotated, a user may arrange an item 140 to be ironed and/or dried on the cylinder 120. When the cylinder 120 is rotated in a direction B it brings, by friction, the item 140 to be fed C in between the chest 110 and the cylinder 120.

When the item passes from intake D to exit E, the item 140 is pressed, ironed and/or dried. The thus treated item is indicated 140' in FIG. 1.

The chest 110 is heated via resistors, fluid channels or gas conduits 150 embedded in the chest 110.

Figure 2:
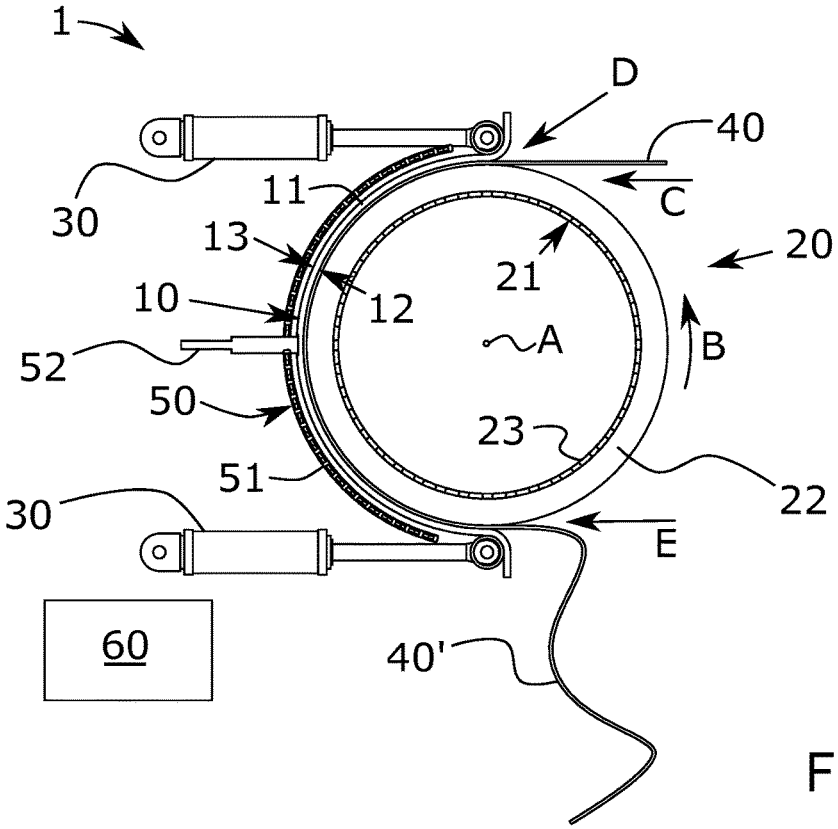
FIG. 2 illustrates a chest ironer according to some embodiments.

FIG. 2 illustrates a chest ironer 1 according to some embodiments herein. The chest ironer 1 comprises a chest 10, a cylinder 20 and displacement means 30 for displacement of the chest 10 and the cylinder 20 relatively each other. The displacement means 30 may also be referred to as pressure means or pressure arrangement since it is arranged for pressing the chest 10 and the cylinder 20 slightly towards each other. The displacement means 30 can comprise e.g. pressurized cylinders and/or resilient organs.

The chest ironer 1 further comprises means for rotating the cylinder 20 around the centre axis A. The rotating means (not shown) may comprise e.g. an electric motor and a transmission arrangement for transfer of a rotating movement to the cylinder 20.

When the cylinder 20 is rotated, a user may arrange an item 40 to be ironed and/or dried on the cylinder 20. When the cylinder 20 is rotated in the direction B it brings, by friction, the item 40 to be fed C into the chest ironer 1. During the transport from an intake D to an exit E the item 40 is pressed, ironed and dried. The treated item is indicated 40' in FIG. 2.

The chest 10 comprises a curved metal plate 11 with a concave side 12, which faces the cylinder 20, and a convex side 13, facing away from the cylinder 20. The concave side 12 may e.g. comprise a smooth or polished surface of steel or the like. The cylinder 20 comprises a cylindrical body 21. The cylinder 20 and/or its cylindrical body 21 may be made of metal or other durable material and may comprise a number of apertures 23. When a wet item 40 is treated by the chest ironer 1 moisture is allowed to escape via the apertures 23. The moisture may then be collected or led away to a drain (not shown). The moisture may be transported as steam from the item to the interior of the cylinder 20 as the item passes between the concave side 12 of the heated metal plate 11 and the cylinder 20 from the intake D to the exit E.

For heating of the chest 10 and the curved metal plate 11, the chest ironer 1 comprises at least one induction arrangement 50. The induction arrangement 50 comprises at least one electrical conductor 51. The at least one electrical conductor 51 is arranged electrically isolated from the chest 10 at the convex side 13 in the embodiment illustrated in FIG. 2. In other embodiments, the induction arrangement 50 or the at least one electrical conductor 51 may be arranged e.g. embedded within the chest 10. The chest may be heated e.g. to 100-200 degrees Celsius, but higher and lower temperatures are possible.

The induction arrangement 50 or the at least one electrical conductor is connectable to a high frequency power source 60. In some embodiments the high frequency power source 60 is an external high frequency power source to which the chest ironer 1 is connected. In some other embodiments, the chest ironer 1 comprises the high frequency power source 60 such that the chest ironer 1 itself can generate a high frequency magnetic field.

The high frequency power source 60 may also be referred to as a "power converter" or "AC/AC power converter", where AC stands for alternating current. The high frequency power source 60 is arranged to convert an input frequency to an output frequency. For example, an input frequency provided by an AC distribution grid may be e.g. 50 Hz. An input power may be e.g. 5,000 W. Since 50 Hz may be too low frequency for the induction arrangement 50 to operate properly, the high frequency power source 60 is arranged to convert the input frequency to an output frequency that is higher than the input frequency. Such an output frequency may e.g. be in the range of 20,000 Hz to 40,000 Hz. An output power may be slightly smaller than the input power due to different kind of losses during the power conversion.

When a high frequency electrical current is fed from the high frequency power source 60 into the one or more electrical conductors 51 of the induction arrangement 1, a high frequency magnetic field is created. The high frequency magnetic field has the same frequency as the output frequency of the high frequency electrical current, i.e. in the range of 20,000 Hz to 40,000 Hz according to the example above. A strong heating effect is obtained when a conductive material, i.e. the metal plate 11 of the chest 10, is in the proximity of a coil or conductor 51 through which the high frequency electrical currents flow. In some embodiments, a plurality of high frequency power sources 60 is used. Such high frequency power sources 60 may be e.g. of single phase type.

A thermal efficiency depends e.g. on geometry of the conductor 51, a number of turns of the conductor 51, a distance between the conductor 51 and the chest 10, the material of the conductor 51 etc. The at least one conductor 51 may for example be made of copper or any other suitable material.

The chest ironer 1 comprises a temperature sensor 52 for control of a chest temperature caused by the induction arrangement 1. In the embodiment of FIG. 2, the temperature sensor 52 is arranged at the convex side 13 of the chest 10 but in other embodiments the temperature sensor 52 is arranged at other suitable positions.

The cylinder 20 in the embodiment illustrated in FIG. 2 comprises a steam-permeable padding 22 which is arranged around a periphery of the cylindrical body 21. As mentioned above, moisture from items to be dried and/or ironed escapes through the steam permeable padding 22 and the apertures 23 as the item passes the heated metal plate 11 of the chest 10. The steam-permeable padding 22 may be porous and/or spongy. The steam-permeable padding 22 may be arranged as a sleeve around the periphery of the cylindrical body 21.

Figure 3:
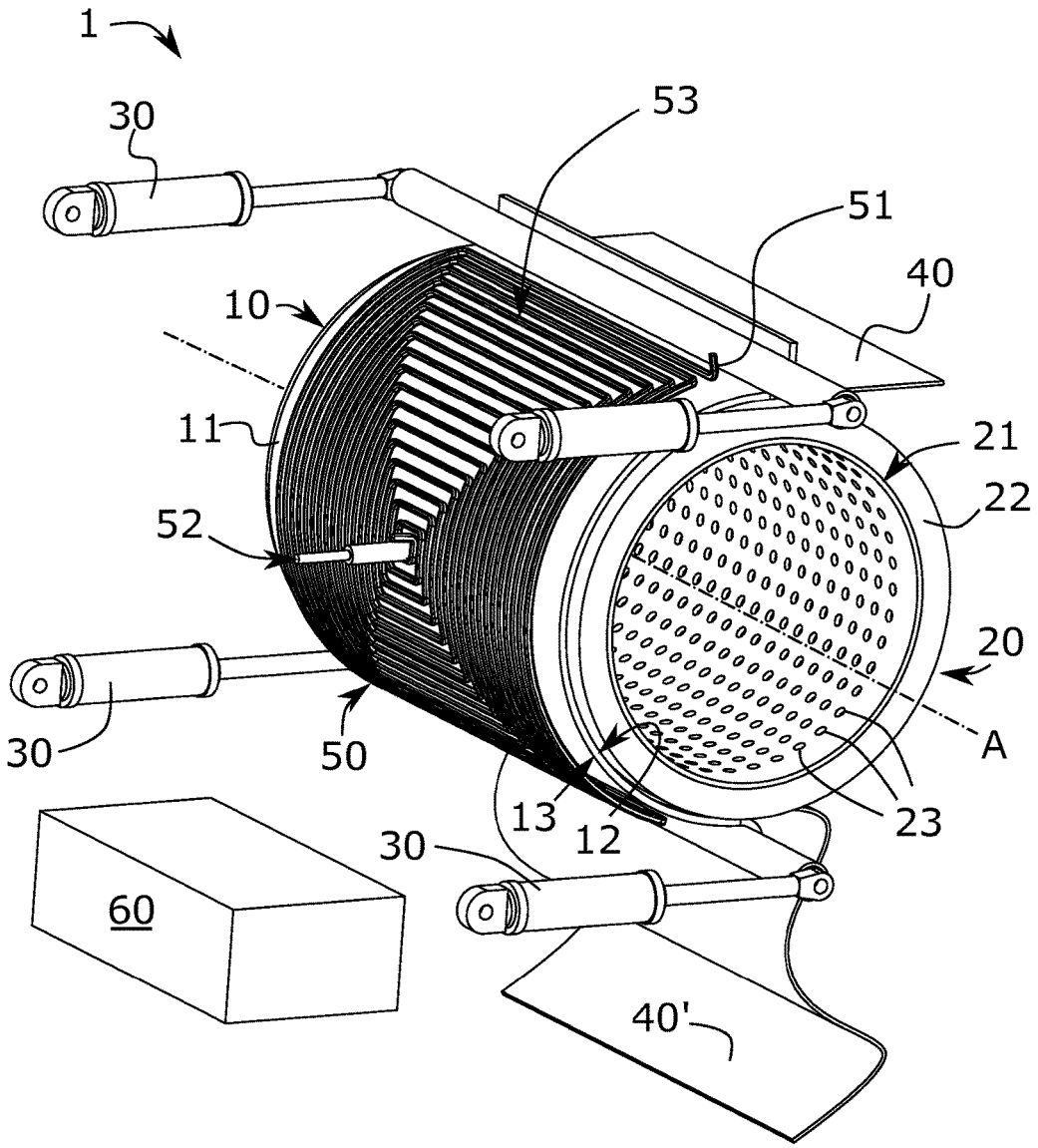
FIG. 3 illustrates a perspective view of the FIG. 2 chest ironer.

FIG. 3 illustrates a perspective view of the chest ironer 1 according to some embodiments. The chest ironer 1 generally resembles the FIG. 2 embodiment and comprises the chest 10, the cylinder 20, the displacement means 30. As previously mentioned the displacement means are arranged to press the chest 10 and the cylinder 20 towards each other. The chest ironer 10 also comprises rotation means (not illustrated) for rotation of the cylinder 20 around the axis A of rotation.

The chest 10 comprises the curved metal plate 11 with the concave side 12 which faces the cylinder 20 and the convex side 13. In some embodiments a thickness of the curved metal plate 11 of the chest 10 is less than 4 mm. In some embodiments a thickness of the curved metal plate 11 of the chest 10 is less than 3 mm. In some embodiments a thickness of the curved metal plate 11 of the chest 10 is less than 2 mm.

In FIG. 3, the at least one induction arrangement 50 for heating of the metal chest 10 is illustrated. The induction arrangement 50 comprises at least one electrical conductor 51 arranged electrically isolated from the chest 10 at the convex side 13 of the chest 10. The at least one electrical conductor 51 is connectable to the high frequency power source 60. The chest ironer 1 comprises a temperature sensor 52 for control of a chest temperature caused by the induction arrangement 50.

The chest 10 and the cylinder 20 are arranged to feed, press and/or dry a sheet material 40, such as sheets, towels, clothes and the like, which is inserted between the cylinder 20 and the concave side 12 of the chest 10 when the cylinder 20 rotates as driven by the rotation means.

The at least one electrical conductor 51 of the induction arrangement 50 forms a rectangular spiral coil 53 which extends in a plane substantially in parallel with the convex side 13 of the chest 10. The main extension plane of the spiral coil 53 may be arranged e.g. directly on but isolated from, the convex side 13 of the chest 10. In some embodiments, the main extension plane of the spiral coil 53 is arranged in a plane substantially in parallel and at a small distance from the convex surface 13, such as a 1-20 mm from the convex side 13.

FIG. 3 also illustrates the cylindrical body 21, the steam permeable padding 22, the item 40, 40' and a plurality of apertures 23.

Figure 4:
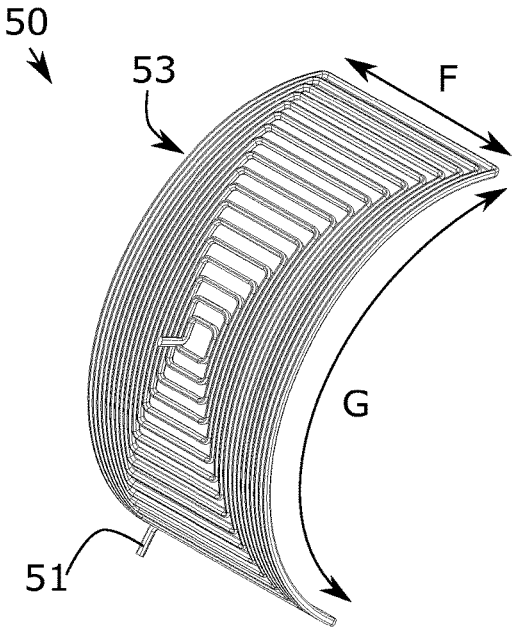
FIG. 4 illustrates an induction arrangement according to some embodiments.

The induction arrangement 50 may be embodied in a number of different shapes and configurations, for example, circular shape, rectangular shape, oval shape or other suitable shapes. The induction arrangement 50 may comprise any suitable number of coils. FIG. 4 illustrates an embodiment in which one single electrical conductor 51 forms a rectangular spiral coil 53. When mounted in/on the chest ironer 1 described above, the rectangular spiral coil 53 extends in a plane substantially parallel with the convex surface of the chest.

Accordingly, the rectangular spiral coil 53 may extend e.g. in a plane which is curved in one dimension. The rectangular spiral coil 53 may have a first extension direction F and a second extension direction G. In the embodiment illustrated in FIG. 4, the first extension direction F follows a straight curve and the second extension direction G follows a semi-circular curve. An extension along the first extension direction is smaller than an extension in the second extension direction. This may mean that the rectangular spiral coil may be elongated along the second extension direction.

Figure 5:
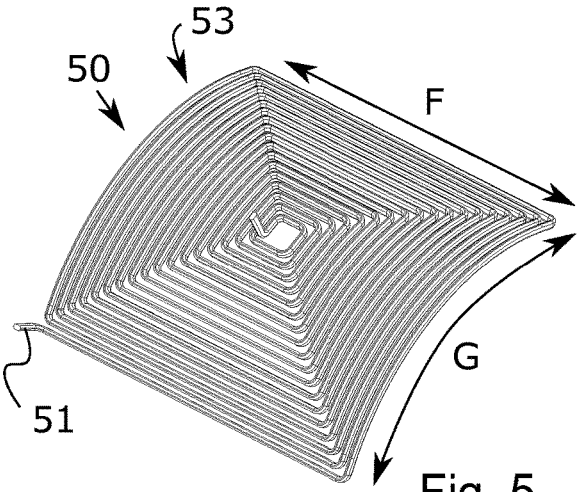
FIG. 5 illustrates an induction arrangement according to some other embodiments.

The embodiment according to FIG. 5 illustrates an embodiment of the conductor 51 and the spiral coil 53 in which the extension along the first extension direction F of the spiral coil 53 is substantially the same as the extension in the second extension direction G. In other embodiments, an extension along the first extension direction F is larger than an extension in the second extension direction G.

Figure 6:
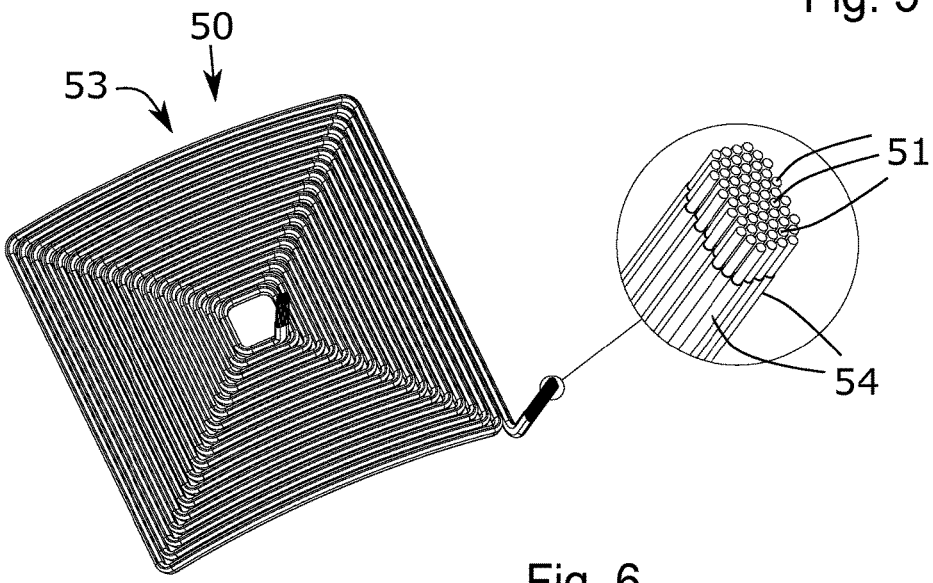
FIG. 6 illustrates an induction arrangement according to yet some other embodiments.

FIG. 6 illustrates an embodiment in which the rectangular spiral coil 53 of the induction arrangement comprises a plurality of electrical conductors 51. The plurality of electrical conductors 51 is electrically isolated from each other and from the chest by an insulation layer 54. The insulation layer may be arranged as a varnish layer, rubber sleeves or similar. The plurality of electrical conductors 51 may, as illustrated in FIG. 6, be arranged in parallel with each other.

Figure 7:
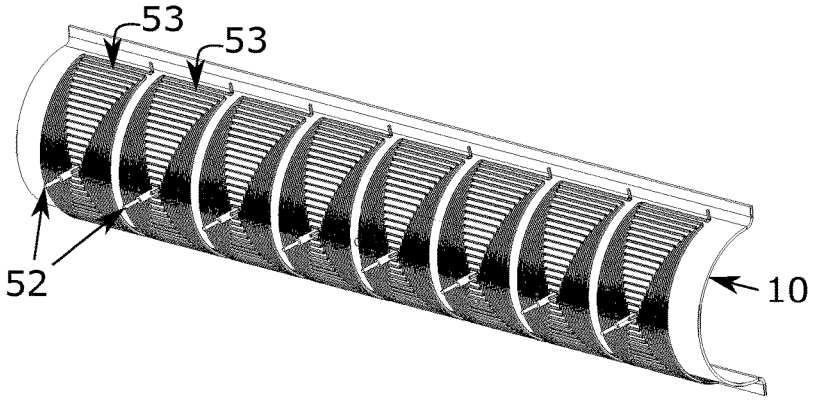
FIG. 7 illustrates a chest and an induction arrangement according to some embodiments.

FIG. 7 illustrates an embodiment where the one or more electrical conductors forms a plurality of rectangular spiral coils 53, each rectangular spiral coil extending in a common plane substantially in parallel with the convex surface of the chest. The embodiment in FIG. 7 also comprises a plurality of temperature sensors 52 for control of chest temperatures at a plurality of different positions. In FIG. 7, eight rectangular spiral coils 53 are arranged next to each other along a width of the chest 10.

In some embodiments the chest ironer comprises a detecting arrangement for detecting the presence of an item to be ironed, and also for detecting a size of the item. The different rectangular spiral coils 53 can be individually activated and de-activated such that only rectangular spiral coils 53 which are needed are activated. For example, if a towel or the like only has a width corresponding to half the width of the cylinder, only 50% of the rectangular spiral coils 53 is activated.

Figure 8:
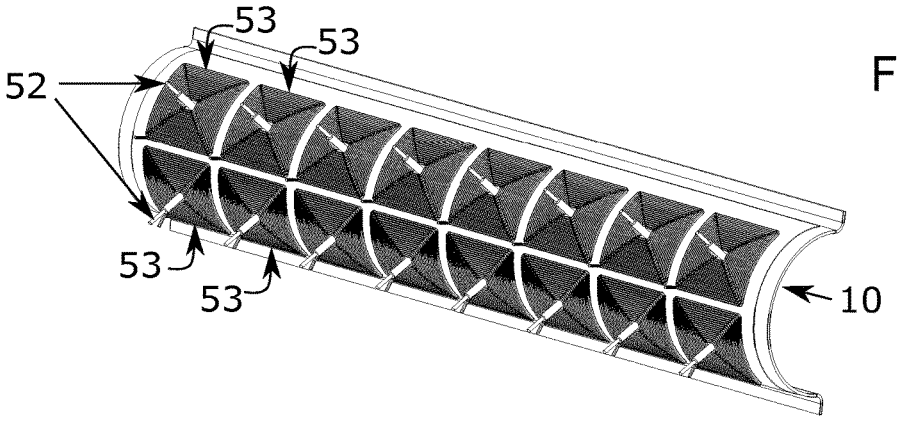
FIG. 8 illustrates a chest and an induction arrangement according to some other embodiments.

In the FIG. 8 embodiment two rows of rectangular spiral coils 53 are arranged on the convex side of the chest 10. A plurality of temperature sensors 52 are arranged to detect a chest temperature at each individual rectangular spiral coil 53.

Figure 9:
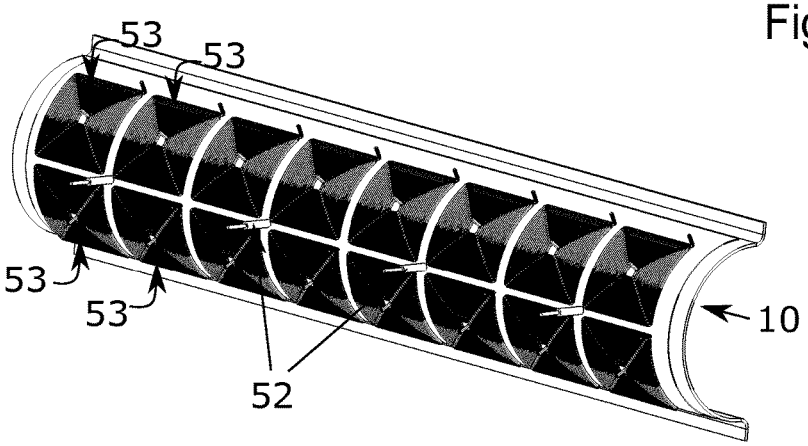
FIG. 9 illustrates a chest and an induction arrangement according to yet some other embodiments.

The FIG. 9 embodiment resembles the FIG. 8 embodiment but in the FIG. 9 embodiment each temperature sensor 52 is arranged to detect a chest temperature for a plurality of rectangular spiral coils 53. In FIG. 8 and FIG. 9 a matrix of 2×8 rectangular spiral coils 53 are arranged at the convex side of the chest 10. In other embodiments, such a matrix may comprise other numbers of spiral coils 53.

Figure 10:
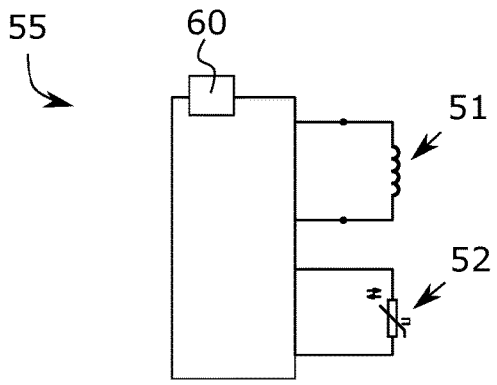
FIG. 10 illustrates a circuit for the induction arrangement according to some embodiments.

FIG. 10 illustrates an example of an electrical circuit 55 which may be used for e.g. the FIG. 3 embodiment. The electrical circuit 55 comprises a high frequency power source 60, electrical conductors in a spiral coil 51 and a temperature sensor 52.

Figure 11:
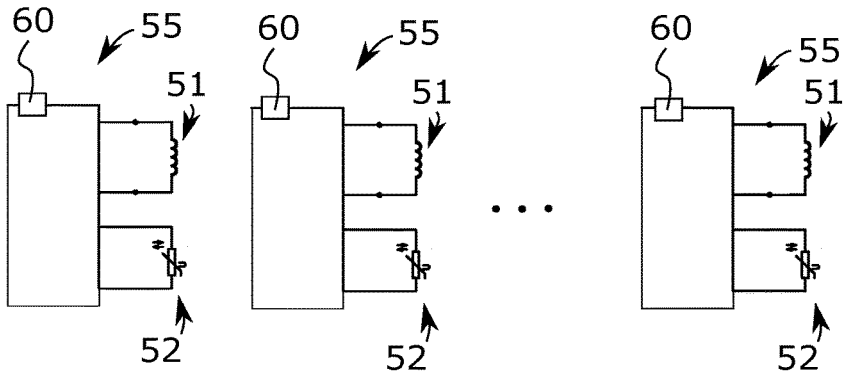
FIG. 11 illustrates a circuit for the induction arrangement according to some other embodiments.

In FIG. 11 an example of electrical circuits 55 for e.g. FIG. 7 or FIG. 8 embodiments is shown. Three electrical circuits 55 are illustrated, but a larger or smaller number is possible. The electrical circuit 55 comprises a high frequency power source 60, electrical conductors in a spiral coil 51 and a temperature sensor 52.

Figure 12:
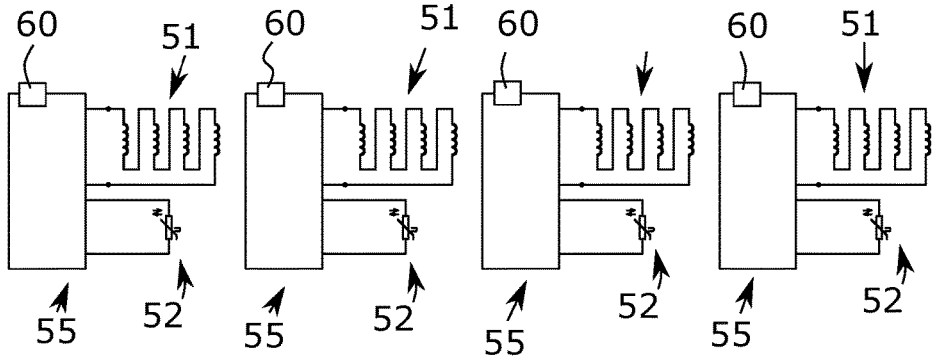
FIG. 12 illustrates a circuit for the induction arrangement according to yet some other embodiments.

FIG. 12 illustrates an example of electrical circuits 55 e.g. for the FIG. 9 embodiment. As illustrated, each temperature sensor 52 is arranged to indicate a temperature caused by the respective rectangular spiral coil, i.e. one of the different rectangular spiral coils of FIG. 9. The electrical circuit 55 comprises a high frequency power source 60, electrical conductors in a spiral coil 51 and a temperature sensor 52.

The invention claimed is:

1. A chest ironer comprising a chest, a cylinder, displacement means for displacement of the chest and the cylinder relatively each other, and rotation means for rotation of the cylinder around an axis of rotation, the chest comprising a curved metal plate with a concave side which faces the cylinder, and a convex side opposite the concave side, the cylinder comprising a cylindrical body, and at least one induction arrangement configured to heat the chest, the induction arrangement comprising at least one electrical conductor arranged at and electrically isolated from the chest at the convex side of the chest, the at least one electrical conductor being connectable to a high frequency power source.

2. The chest ironer according to claim 1, wherein the induction arrangement comprises a plurality of electrical conductors which are electrically isolated from each other and from the chest at the convex side of the chest.

3. The chest ironer according to claim 1, wherein the at least one electrical conductor forms a rectangular spiral coil which extends in a plane substantially parallel with the convex side of the chest.

4. The chest ironer according to claim 1, wherein the at least one or more electrical conductor forms a plurality of rectangular spiral coils, each rectangular spiral coil extending in a common plane substantially parallel with the convex side of the chest.

5. The chest ironer according to claim 1, wherein the chest ironer comprises a temperature sensor for control of a chest temperature caused by the induction arrangement.

6. The chest ironer according to claim 5, wherein the temperature sensor is arranged at the convex side of the chest.

7. The chest ironer according to claim 5, wherein the chest ironer comprises a plurality of temperature sensors for control of chest temperatures at a plurality of different positions.

8. The chest ironer according to claim 1, wherein the displacement means are arranged to press the chest and the cylinder towards each other.

9. The chest ironer according to claim 1, wherein the chest and the cylinder, when the cylinder is brought to rotate by the rotation means, are arranged to feed, press and dry a sheet material inserted between the cylinder and the concave side of the chest.

10. The chest ironer according to claim 1, wherein the cylinder comprises a steam-permeable padding which is arranged around a periphery of the cylindrical body.

11. The chest ironer according to claim 1, wherein a thickness of the curved metal plate of the chest is less than 4 mm.

12. The chest ironer according to claim 1, wherein the chest ironer comprises a high frequency power source which is arranged to generate a high frequency magnetic field.

* * * * *